United States Patent [19]

Theurer et al.

[11] Patent Number: 5,063,856

[45] Date of Patent: Nov. 12, 1991

[54] MACHINE FOR PICKING UP TIE PLATES

[75] Inventors: Josef Theurer, Vienna; Herbert Wörgötter, Linz, both of Austria

[73] Assignee: Franz Plasser Bahnbaumaschinen-Industriegesellschaft M.B.H., Vienna, Austria

[21] Appl. No.: 598,556

[22] Filed: Oct. 16, 1990

[51] Int. Cl.[5] ..... E01B 29/10

[52] U.S. Cl. ..... 104/9; 104/7.1

[58] Field of Search ..... 104/2, 7.1, 7.2, 9, 104/307, 16

[56] References Cited

U.S. PATENT DOCUMENTS

| | | | |
|---|---|---|---|
| 3,698,324 | 10/1972 | Peppin et al. | 104/9 |
| 4,611,541 | 9/1986 | Theurer . | |
| 4,809,614 | 3/1989 | Theurer et al. | 104/9 X |
| 4,862,806 | 9/1989 | Theurer et al. . | |

*Primary Examiner*—Dennis H. Pedder

*Assistant Examiner*—Joseph D. Pape

*Attorney, Agent, or Firm*—Collard, Roe & Galgano

[57] ABSTRACT

A machine for picking up and storing tie plates of a railroad track comprises the combination of a machine frame, two vertically adjustable tie plate pick-up devices transversely spaced from each other on the machine frame, the tie plate pick-up devices being vertically adjustable between a lower pick-up position wherein their transverse spacing corresponds to the track gage and an upper tie plate depositing position, a storage device arranged on the machine frame for receiving the tie plates from the pick-up devices in their upper tie plate depositing position, a transversely displaceable device mounted on the machine frame for transversely displacing a track tie within a range of about 30 cm to about 100 cm, and a vertically adjustable rail lifting device mounted on the machine frame adjacent the track tie displacing device.

6 Claims, 3 Drawing Sheets

Fig.1
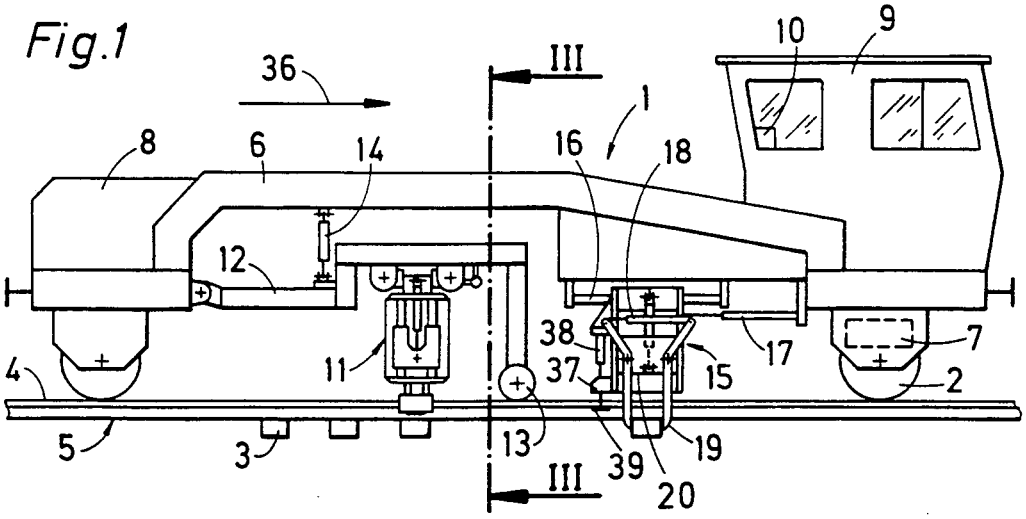
Fig.2
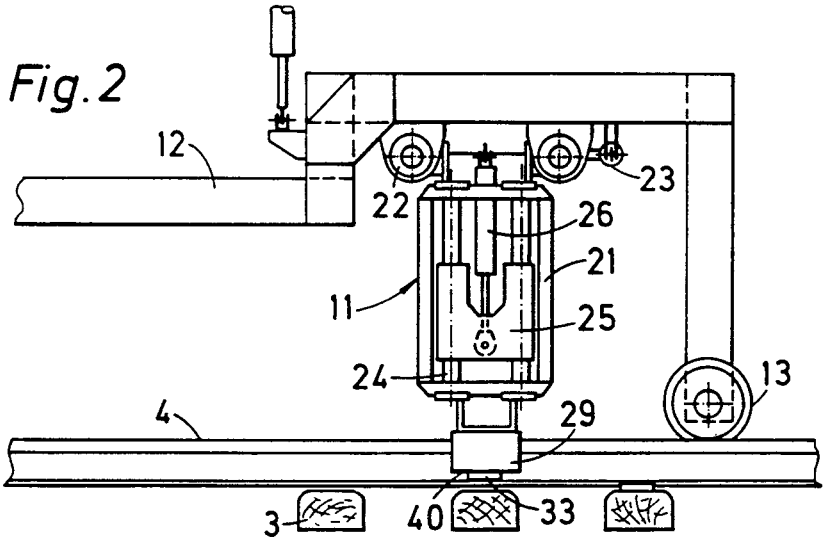
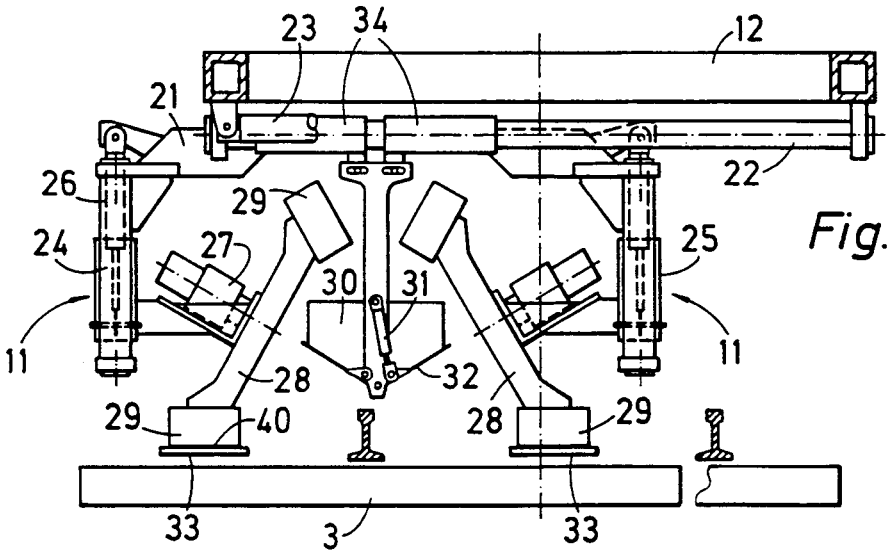
Fig.3

Fig. 7
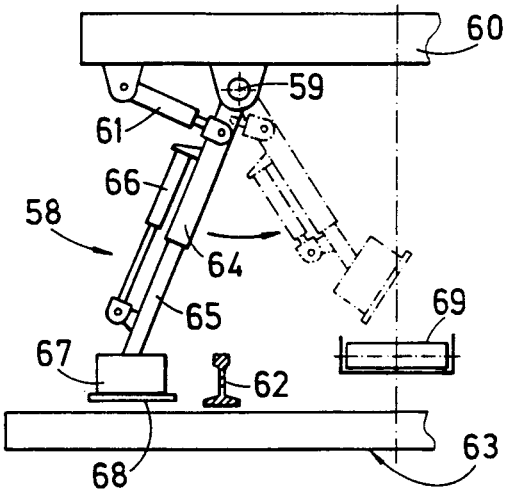
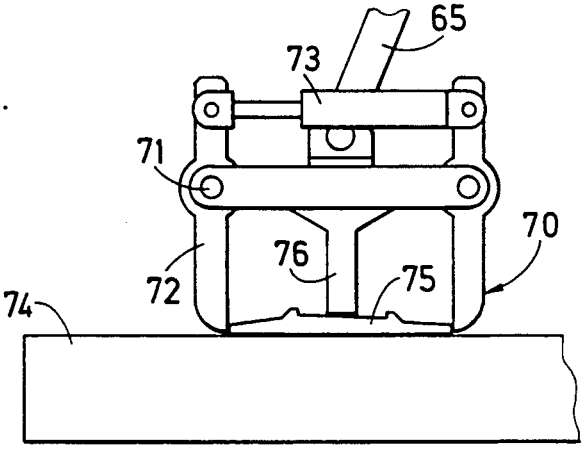
Fig. 8
Fig. 9
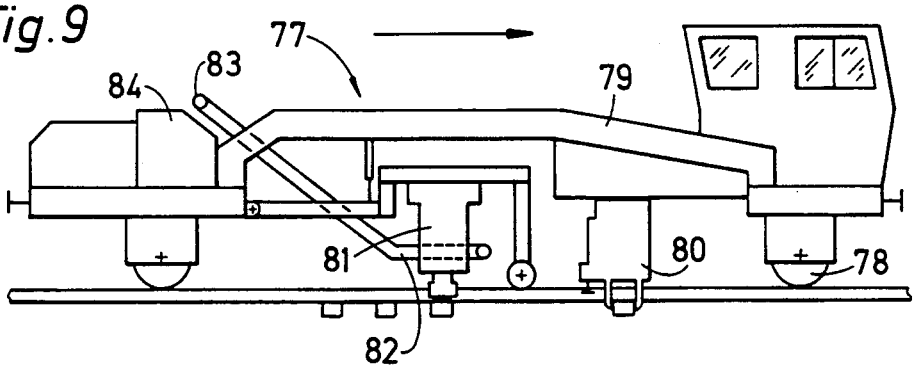

MACHINE FOR PICKING UP TIE PLATES

BACKGROUND OF THE INVENTION

1. Field of the Invention

The present invention relates to a machine for picking up and storing tie plates of a railroad track comprising ties and two rails supported thereon.

2. Description of the Prior Art

In track rehabilation operations requiring the removal of individual damaged ties and their replacement by new ties, the tie plates interposed between the damaged ties and the rails are collected after removal of the spikes fastening the rails to the ties, and the collected tie plates are then used again when the rails are fastened to the replaced ties. It has long been the practice to remove the tie plates manually from the damaged ties after the rails were slightly lifted by winches. This was not only very time-consuming but often led to accidents because of the tensional stresses on the lifted rails and the unsteady support of the winches on the loose ballast bed.

In our U.S. Pat. No. 4,862,806, dated Sept. 5, 1989, we disclosed a mobile tie gang apparatus and tie exchange method wherein groups of ties are sequentially exchanged in an existing railroad track. The apparatus comprises a continuously moving train of elongated, bridge-like machine frames mounted on undercarriages, and a succession of different individual devices are longitudinally displaceably mounted in upwardly recessed portions of the machine frames and are operative to effectuate different sequential operations for exchanging selected old ties for the new ties. While in operation during the continuous advancement of the train, the devices are held in place. These devices include a spike puller carried by the leading machine frame, a magnetic drum for continuously collecting the pulled spikes, and a tie puller for partially pulling the selected ties out of the track. Mounted on the following machine frame is a longitudinally displaceable magnetic tie plate pick-up device to remove the tie plates from the partially pulled ties which are then fully pulled out of the track by a tie pulling and inserting device.

Instead of the tie plate pick-up device disclosed in this patent, magnetic tie plate pick-up devices which are vertically adjustable between a lower pick-up position and an upper tie plate depositing position, wherein the pick-up magnet is briefly demagnetized to deposit the picked-up tie plate on a storing device, have been used.

Tie gang trains of this type have been operated with great success but their use is economical only if large numbers of ties are to be exchanged.

Vertically and transversely adjustable tie exchange devices for pulling and inserting ties are well known and have been disclosed, for example, in U.S. Pat. No. 4,611,541, dated Sept. 16, 1986.

SUMMARY OF THE INVENTION

It is the primary object of this invention to provide a machine for removing tie plates automatically under the control of a single operator and without any manual intervention, which may be used independently or in conjunction with various other tie exchange devices in an automated tie gang train.

The above and other objects are accomplished according to the invention with a machine for picking up and storing tie plates of a railroad track comprising ties and two rails supported thereon, which comprises the combination of a machine frame supported by undercarriages for mobility on the track, a drive for moving the machine frame along the track in an operating direction, at least two tie plate pick-up devices transversely spaced from each other on the machine frame, the tie plate pick-up device being vertically adjustable between a lower pick-up position wherein their transverse spacing corresponds to the track gage and an upper tie plate depositing position, drive means for vertically adjusting the pick-up devices, at least one storage device arranged on the machine frame for receiving the tie plates from the pick-up devices in their upper tie plate depositing position, a transversely displaceable device mounted on the machine frame for transversely displacing a track tie within a range of about 30 cm to about 100 cm, a drive for transversely displacing the track tie displacing device, a vertically adjustable rail lifting device mounted on the machine frame adjacent the track tie displacing device, and a drive for vertically adjusting the rail lifting device.

Such a machine enables selected ties to be sufficiently displaced transversely to enable the tie plates to be removed and immediately thereafter to pick up the tie plates, both operations being observable and controllable by a single operator. Since the two operations immediately succeed each other, any vibrations caused by the moving undercarriages of the machine frame or like effects will not cause the tie plates to fall off the partially pulled tie or uncontrollably displace the same therealong. The storage device on the machine frame enables the picked up tie plates to be collected so that they can be rationally used again.

According to one preferred embodiment of the present invention, each pick-up device comprises a magnet effective to pick up a respective one of the tie plates in the lower pick-up position and demagnetizeable in the upper tie plate depositing position. This provides a very simple and trouble-free device for picking up even slightly displaced tie plates and to deposit them without any problems.

If the track tie displacing device is mounted on the machine frame for movement in a direction extending longitudinally with respect to the machine frame and parallel to the operating direction, and further comprises a drive for longitudinally moving the track tie displacing device whereby the spacing between the track tie displacing device and the tie plate pick-up devices may be changed, the machine can be used in a continuously advancing tie exchange train.

Preferably, the two tie plate pick-up devices are arranged on the machine frame to define a transverse plane of symmetry, the track tie displacing device being arranged symmetrically with respect to the plane of symmetry and the tie plate pick-up devices being encompassed by the track tie displacing device in a direction extending transversely to the machine frame. This enables the tie plate pick-up devices and the track tie displacing device to be centered with respect to a selected tie in a single operation.

According to another preferred feature, the storage device is arranged between the two tie plate pick-up devices and comprises a conveyor band adjustably driven in a conveying direction and extending longitudinally with respect to the machine frame, the conveyor band having a leading end with respect to the conveying direction, and a container adjacent the leading conveyor band end and arranged for receiving the picked-up tie plates from the conveyor band. This enables the picked up tie plates to be automatically collected in a container for rational re-use without any manual intervention.

In another embodiment of the invention, each pick-up device comprises tongs including two tong parts reciprocable towards and away from each other, a drive for reciprocating the tong parts, a carrier arm having opposite ends, one carrier arm end supporting the tongs, the opposite carrier arm end being pivotally mounted on the machine frame for pivoting about a axis extending longitudinally with respect to the machine frame, and a drive for pivoting the carrier arm. This mechanical removal of the tie plates makes it possible to pick up tie plates which strongly adhere to the ties.

BRIEF DESCRIPTION OF THE DRAWING

The above and other objects, advantages and features of the present invention will become more apparent from the following detailed description of certain now preferred embodiments thereof, taken in conjunction with the accompanying, partly schematic drawing wherein FIG. 1 is a side elevational view of a machine according to this invention;

FIG. 2 is an enlarged side elevational view of the tie plate pick-up device of FIG. 1;

FIG. 3 is an enlarged cross-sectional view along line III—III of FIG. 1;

FIGS. 7 and 8 are simplified illustrations of different embodiments of tie plate pick-up devices for use in the machine; and FIG. 9 is a diagrammatic side view showing another embodiment of the machine of the invention.

DESCRIPTION OF THE PREFERRED EMBODIMENTS

Figure 4:
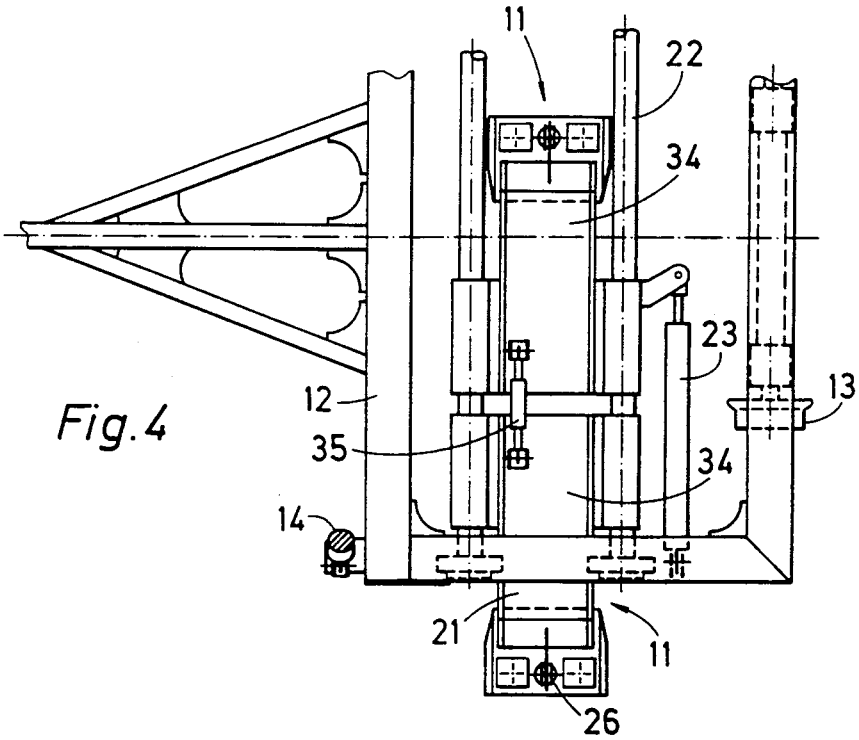
FIG. 4 is an enlarged top view of this tie plate pick-up device.

Referring now to the drawing and first to FIG. 1, there is shown machine 1 for picking up and storing tie plates of railroad track 5 comprising ties 3 and two rails 4 supported thereon. This machine comprises machine frame 6, undercarriages 2 supporting machine frame 6 for mobility on the track in an operating direction, indicated by arrow 36, and drive 7 for moving the machine frame along the track in the operating direction. The machine frame carries power plant 8 and operator's cab 9 housing central control panel 10 for enabling an operator in the cab to control the various drives.

Machine frame 6 has an upwardly recessed portion extending between undercarriages 2, in which the operating devices of the machine are mounted. These operating devices include two tie plate pick-up devices 11 transversely spaced from each other on machine frame 6, the tie plate pick-up device being vertically adjustable between a lower pick-up position wherein their transverse spacing corresponds to the track gage and an upper tie plate depositing position. In the illustrated embodiment, tie plate pick-up devices 11 are mounted on carrier frame 12 which extends longitudinally with respect to machine frame 6 and has one end pivoted to the machine frame while its opposite end is supported on track rails 4 by two flanged wheels 13. Drive 14 links carrier frame 12 to machine frame 6 intermediate the opposite ends of the carrier frame so that the flanged wheels may be lifted off the track when machine 1 is moved from one operating site to another. Transversely displaceable device 15 is mounted on machine frame 6 within view of operator's cab 9 for transversely displacing a track tie within a range of about 30 cm to about 100 cm. The illustrated track tie displacing device is mounted on guide rods 16 affixed to the machine frame for movement in a direction extending longitudinally with respect to the machine frame and parallel to the operating direction, and drive 17 is provided for longitudinally moving track tie displacing device 15 whereby the spacing between the track tie displacing device and tie plate pick-up devices 11 may be changed. The illustrated track tie displacing device includes drives for vertically adjusting and transversely displacing the track tie displacing device. Such a device has been more fully described in U.S. Pat. No. 4,611,541 and includes tongs 20 for gripping tie 3 between tong parts 19 interconnected by drive 18 for clamping the tie therebetween when it is desired to displace it transversely.

Tie pick-up devices 11 illustrated in detail in FIGS. 2 to 4 are of the type disclosed in U.S. Pat. No. 4,862,806. They are mounted on transversely extending frame 21 which is transversely displaceable by drive 23 along guide rods 22 affixed to carrier frame 12. As shown particularly in FIG. 3, drive means for vertically adjusting the pick-up devices include respective vertical guides 24 at each end of frame 21 and tool carriers 25 vertically displaceable along guides 24 by drives 26 linked to transversely extending frame 21. Rotary drive 27 is connected to each tool carrier 25 and carrier beam 28 is affixed to the rotary shaft of drive 27. The carrier beam encloses an angle of about 60° with the horizontal and each end thereof carries magnet 29. Storage device 30 is arranged on the machine frame for receiving tie plates 33 from pick-up devices 11 in their upper tie plate depositing position, being affixed to transversely extending frame 21.

The illustrated storage device is a funnel-shaped container which is open on top, and flap 32 is hinged to the bottom of the container. Drive 31 is linked to the flap to enable the same to be opened for unloading tie plates collected in the container. The storage device is centered between tie plate pick-up devices 11 and lower magnets 29 of the two tie plate pick-up devices which are spaced from each other a distance corresponding to the track gage so that they are in alignment with tie plates 33 of transversely displaced tie 3. Magnets 29 are effective to pick up a respective tie plate 33 in the lower pick-up position and demagnetizeable in the upper tie plate depositing position for dropping the picked up tie plate into the storage device.

Transversely extending and displaceable frame 21 is comprised of two parts 34, each carrying one of the tie plate pick-up devices 11 (see particularly FIG. 4), and the two frame parts are interconnected by drive 35 to enable their spacing to be slightly varied so that the distance between magnets 29 of the two devices 11 may be correspondingly selected.

Vertically adjustable rail lifting device 37 is mounted on machine frame 6 adjacent track tie displacing device 15, and drive 38 is provided for vertically adjusting the rail lifting device.

In operation and after the spikes have been removed from the ties to be pulled out of track 5, machine 1 is driven in the operating direction indicated by arrow 36 until tie clamping tongs 20 in their longitudinally displaced forward position are centered above the end of tie 3 to be transversely displaced. In this position, tongs 20 are lowered and drive 18 is actuated to move tong parts 19 towards each other for clamping the tie end therebetween. At the same time, rail lifting device 37 is lowered by actuation of drive 38 and lifting rollers 39 of device 37 are pivoted into engagement with rail 4 below the rail head. Drive 38 is then actuated in the opposite direction to lift the rail slightly adjacent transverse tie displacing device 15 so that a gap is formed between the foot of the rail and the tie to be displaced, the gap being sufficient to enable tie plate 33 to freely move therethrough as the tie is transversely displaced. Since longitudinal displacement drive 17 enables tie displacing device 15 to be longitudinally displaced with respect to machine frame 6, machine 1 may be continuously moved forward while device 15 is held in place during the transverse displacement of the tie by controlled relieve of the pressure in hydraulic drive 17. As soon as the longitudinal rear position of tie displacing device 15 has been reached during the slow continuous forward movement of machine 1 and the transverse tie displacement has been terminated, drive 18 is actuated to release the displaced tie from tongs 20, the tongs are raised and device 15 is retracted back into its longitudinal forward position by actuation of drive 17, ready for the next tie displacement operation.

For the entire operation of machine 1, the two tie plate pick-up devices 11 are transversely displaced by actuation of drive 23 by a distance corresponding to that of the transverse displacement of selected ties by device 15, which preferably remains constant. As shown in FIG. 3, lower tie plate pick-up magnets 29 are moved during the continuous slow advancement of machine 1 over tie plates 33 which have been transversely moved with tie 3 whereon they rest, and the magnets pull the tie plates up to lower magnet surface 40. The lower magnet surfaces are so spaced from tie plates 33 on tie 3 that the magnetic pull will automatically lift the tie plates off the underlying tie. Carrier beams 28 are now turned 180° by actuation of rotary drives 27 so that lower magnets 29 will be moved from their lower pick-up position into their upper depositing position, whereupon the magnets are temporarily demagnetized to cause the picked up tie plates to fall into storage device 30. During the rotation of carrier beams 28, repositioned upper magnets 29 are automatically re-magnetized so that pick-up devices 11 are ready for the next operation. When tie clamping tongs 20 have reached the next tie to be pulled, the above-described operation is repeated. Of course, it is possible to effectuate the successive operations while machine 1 is held in place during each operation, in which case longitudinal displacement drive 17 for device 15 is not operated. Partially pulled ties 3 are entirely pulled out of track 5 and new ties are inserted in their place by a tie exchange apparatus following machine 1, after tie plates 33 have been removed.

When storage container 30 is full, drive 31 is actuated to pivot bottom flap 32 open and thus to empty the container and form a heap of tie plates between track rails 4. These tie plates can then be recovered, for example by a magnetic crane or the like, for re-use.

Figure 5:
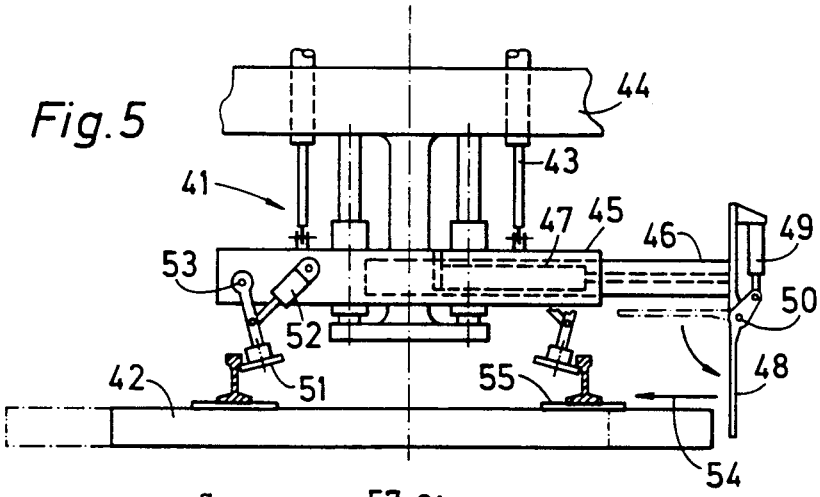
FIG. 5 is a simplified illustration of a track tie displacing device for use in the machine.

FIG. 5 shows another embodiment of a transverse tie displacing device for use in the machine of the present invention. Illustrated device 41 for transversely displacing tie 42 comprises telescopic carrier 45 vertically adjustably mounted on machine frame 44 by drives 43, telescopingly extending arm 46 of carrier 45 being displaceable by drive 47 in the direction of the longitudinal extension of tie 42. A free end of telescopingly extending arm 46 carries pressure plate 48 which is pivotal about axis 50 extending perpendicularly to this direction by drive 49 between a horizontal rest position (shown in phantom lines and used during the movement of the machine between operating sites) and a vertical operating position (shown in full lines in the drawing). Telescopic carrier 45 carries rail lifting rollers 51 pivotal into clamping engagement with the track rails about axes 53 by drives 52.

For the transverse displacement of tie 42 in the direction indicated by arrow 54 from the position shown in full lines to the position shown in phantom lines, wherein the right end of the tie comes to rest just before it reaches the edge of the foot of the right rail, the machine is advanced until telescopic carrier 45 is centered above the tie. Drives 43 are then actuated to lower the telescopic carrier until rail lifting rollers 52 come to subtend the rail heads upon actuation of drives 52. At the same time, pressure plate 48 is lowered into its operating position in alignment with the right tie end. Drives 43 are now actuated again for slightly lifting the rails engaged by lifting rollers 51 until a gap of about 35 mm to 40 mm appears between the feet of the rails and the underlying tie. While this also causes a corresponding slight lifting of pressure plate 48, this in no way hampers the functioning of the pressure plate for transversely displacing tie 42, actuation of drive 47 causing the pressure plate to engage the tie end and to displace the tie transversely into the position shown in phantom lines. Tie plates 55 are displaced with the tie in a manner explained fully hereinabove and are picked up in the described manner.

Figure 6:
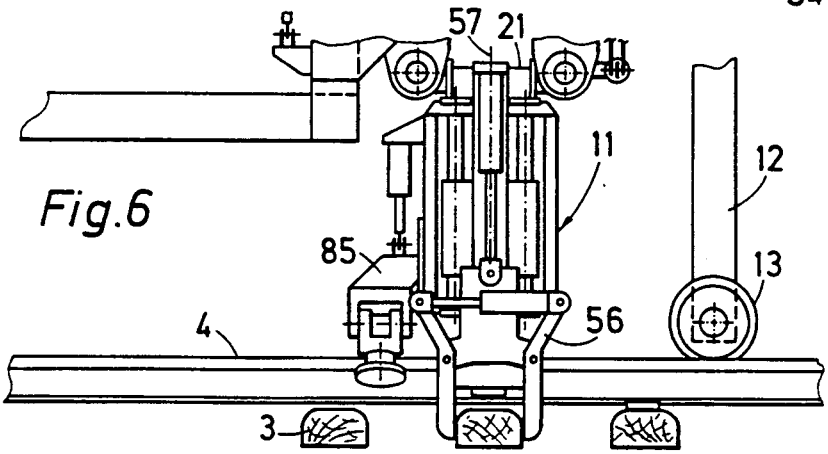
FIG. 6 is a simplified fragmentary side elevational view showing a preferred embodiment of a combined tie plate pick-up and tie displacement device.

In the embodiment illustrated in FIG. 6, wherein like parts are designed by the same reference numerals as in FIGS. 1–4, the two tie plate pick-up devices 11 are arranged on the machine frame to define transverse plane of symmetry 57, track tie displacing tongs 56 being arranged symmetrically with respect to the plane of symmetry and the tie plate pick-up devices being encompassed by the track tie displacing ton parts in a direction extending transversely to the machine frame. The tie clamping tongs 56 as well as rail lifting device 85 are vertically adjustably mounted on frame 21 by vertical adjustment drives.

FIG. 7 schematically illustrates half of another embodiment of a tie plate pick-up device adjacent one rail 62 and in operating position above tie 63. Illustrated pick-up device 58 comprises carrier arm 64, 65 having opposite ends, one carrier arm end supporting magnet 67, the opposite carrier arm end being pivotally mounted on machine frame 60 for pivoting about axis 59 extending longitudinally with respect to the machine frame, and drive 61 linking the carrier arm to the machine frame for pivoting the carrier arm. The illustrated carrier arm of pick-up device 58 is comprised of a telescopic carrier 64 and telescopingly extending arm 65 longitudinally displaceable in the telescopic carrier by drive 66. Pivoting of carrier arm 64, 65 moves magnet 67 from a lower pick-up position shown in full lines, wherein it picks up tie plate 68, to an upper tie plate depositing position shown in phantom lines, drives 61 and 66 being actuated simultaneously to pivot the carrier arm and to retract telescopingly extending arm 65. In this position, magnet 67 is demagnetized, causing the picked up tie plate to fall onto the tie plate storage device arranged between the two tie plate pick-up devices (the other pick-up device not being shown in the drawing and being identical with the illustrated tie pick-up device). The illustrated storage device comprises conveyor band 69 adjustably driven in a conveying direction and extending longitudinally with respect to machine frame 60, the conveyor band having a leading end with respect to the conveying direction, and a container adjacent the leading conveyor band end and arranged for receiving the picked-up tie plates from the conveyor band. As in the previously described embodiment of the tie plate pick-up device, magnet 67 is automatically re-magnetized when it is adjusted back into its lowered operating position for pick-up of another tie plate.

In the modification of FIG. 8, tie plate pick-up magnet 67 carried by the lower end of telescopingly extending carrier arm 65 is replaced by tongs 70 comprising two tong parts 72 reciprocable towards and away from each other about axes 71 extending in a direction perpendicular to tie 74, and drive 73 links the upper ends of the tong parts for reciprocating the same to grip tie plate 75 resting on tie 74. Stop 76 is arranged between tong parts 72 for engagement with tie plate 75 in the lowered operating position of pick-up device 58 so that the lower end of tong parts 72 are in gripping engagement with the tie plate but are slightly spaced from the upper surface of tie 74.

FIG. 9 diagrammatically shows machine 77 comprising machine frame 79 supported on undercarriages 78 for mobility on a track. Transverse tie displacing device 80 and two tie plate pick-up devices 81 are mounted on the machine frame between the undercarriages in a manner described in connection with FIG. 1. The tie plate storage device of this machine comprises an elongated conveyor band 82 extending between the two tie plate pick-up devices in a longitudinal direction with respect to machine frame 79, the conveyor band ascending from a pick-up position to an opposite end 83 above container 84. The picked up and conveyed tie plates are thrown off conveyor band end 83 into container 84. Device 80 and 81 may take any desired form, including the embodiments described and illustrated hereinabove.

What is claimed is:

1. A machine for picking up and storing tie plates of a railroad track comprising ties and two rails supported thereon, which comprises the combination of (a) a machine frame, (b) undercarriages supporting the machine frame for mobility on the track, (c) a drive for moving the machine frame along the track in an operating direction, (d) at least two tie plate pick-up devices transversely spaced from each other on the machine frame, the tie plate pick-up devices being vertically adjustable between a lower pick-up position wherein their transverse spacing corresponds to the track gage and an upper tie plate depositing position, (f) at least one storage device arranged on the machine frame for receiving the tie plates from the pick-up devices in their upper tie plate depositing position, (g) a transversely displaceable device mounted on the machine frame for transversely displacing a track tie within a range of about 30 cm to about 100 cm, (h) a drive for transversely displacing the track tie displacing device, (i) a vertically adjustable rail lifting device mounted on the machine frame adjacent the track tie displacing device, and (j) a drive for vertically adjusting the rail lifting device.

2. The machine of claim 1, wherein each pick-up device comprises a magnet effective to pick up a respective one of the tie plates in the lower pick-up position and demagnetizeable in the upper tie plate depositing position.

3. The machine of claim 1, wherein the track tie displacing device is mounted on the machine frame for movement in a direction extending longitudinally with respect to the machine frame and parallel to the operating direction, further comprising a drive for longitudinally moving the track tie displacing device whereby the spacing between the track tie displacing device and the tie plate pick-up devices may be changed.

4. The machine of claim 1, wherein the two tie plate pick-up devices are arranged on the machine frame to define a transverse plane of symmetry, the track tie displacing device being arranged symmetrically with respect to the plane of symmetry and the tie plate pick-up devices being encompassed by the track tie displacing device in a direction extending transversely to the machine frame.

5. The machine of claim 1, wherein the storage device is arranged between the two tie plate pick-up devices and comprises a conveyor band adjustably driven in a conveying direction and extending longitudinally with respect to the machine frame, the conveyor band having a leading end with respect to the conveying direction, and a container adjacent the leading conveyor band end and arranged for receiving the picked-up tie plates from the conveyor band.

6. The machine of claim 1, wherein each pick-up device comprises tongs including two tong parts reciprocable towards and away from each other, a drive for reciprocating the tong parts, a carrier arm having opposite ends, one carrier arm end supporting the tongs, the opposite carrier arm end being pivotally mounted on the machine frame for pivoting about an axis extending longitudinally with respect to the machine frame, and a drive for pivoting the carrier arm.

* * * * *